United States Patent [19]

Reiter

[11] Patent Number: 4,830,887

[45] Date of Patent: May 16, 1989

[54] CURTAIN COATING METHOD AND APPARATUS

[75] Inventor: Thomas C. Reiter, Hilton, N.Y.

[73] Assignee: Eastman Kodak Company, Rochester, N.Y.

[21] Appl. No.: 185,207

[22] Filed: Apr. 22, 1988

[51] Int. Cl.[4] ..... B05D 1/30

[52] U.S. Cl. ..... 427/420; 427/411; 118/412; 118/DIG. 4

[58] Field of Search ..... 427/420, 411; 118/412, 118/DIG. 4

[56] References Cited

U.S. PATENT DOCUMENTS

| | | | |
|---|---|---|---|
| 3,749,053 | 7/1973 | Timson | 118/DIG. 4 |
| 4,233,346 | 11/1980 | Kerkhofs | 118/DIG. 4 |
| 4,443,504 | 4/1984 | Burket et al. | 118/412 |
| 4,479,987 | 10/1984 | Koepke et al. | 118/DIG. 4 |
| 4,647,482 | 3/1987 | Degrauwe et al. | 118/DIG. 4 X |

*Primary Examiner*—Shrive Beck

*Attorney, Agent, or Firm*—Herman J. Strnisha

[57] ABSTRACT

Method and apparatus for applying one or a plurality of superimposed layers of a photographic coating composition by the curtain coating method onto a moving support. The spacing between the edge guides, used to maintain the width of a curtain throughout its free fall from the coating hopper to the impingement line on the support, is arranged to coat less than the width of the support so as to provide an uncoated margin on the support. The curtain fluids are extracted from the edge region of the falling curtain by connecting a suction device to the edge guides near the point of impingement of the falling curtain, thus substantially reducing the thickness of the curtain at its edge region and thereby reducing the thickness of the coated edges.

25 Claims, 5 Drawing Sheets

CURTAIN COATING METHOD AND APPARATUS

FIELD OF THE INVENTION

The present invention relates to a method and apparatus for coating objects or moving supports, advancing continuously past a coating station, by the curtain coating method. More particularly, it relates to an improved curtain coating method and apparatus for the manufacture of photographic materials such as photographic film and paper.

BACKGROUND OF THE INVENTION

In coating apparatus of the curtain coating type, a moving support is coated by causing a free falling vertical curtain of coating liquid to impinge onto the moving support to form a layer on said support. An apparatus is described in Hughes U.S. Pat. No. 3,508,947 wherein a multilayer composite of a plurality of distinct layers is formed on a slide hopper and caused to impinge onto an object or moving support to form a coated layer thereon. U.S. Pat. No. 3,508,947 particularly relates to the manufacture of multilayer photographic materials such as photographic film and paper.

In the curtain coating process, particularly as used to manufacture multilayer photographic materials, the quality of coating is largely determined by the properties of the liquid curtain. It is important to insure that a stable laminar flow of liquid film is formed by the slide hopper and that an equally stable, laminar flow liquid curtain is formed from that film. To prevent contraction of the falling curtain under the effect of surface tension, it is known that the curtain width must be guided at its edges by curtain edge guides.

In general, edge guides are stationary, solid members which are attached to the slide hopper used to supply coating liquid to the curtain and extend downwardly from the initial point of free fall of the curtain. Wetting contact of the edges of the falling curtain with the edge guides should be maintained the entire length of the edge guide to avoid a break in the curtain.

The curtain edge guides have been arranged in such a way that the moving support is coated: (a) up to the edge, (b) leaving an uncoated margin on the support edges or (c) in such a way that the width of the coating liquid extends beyond one or both of the support edges. In any of these three coating processes, an edge band liquid can be supplied to the lateral sides of the curtain to stabilize the curtain, and this liquid is collected and recirculated for reuse. A curtain coating process using such edge band liquid technique is disclosed in U.S. Pat. No. 4,019,906 issued on Apr. 26, 1977, and in *Research Disclosure,* No. 17553, dated November, 1978.

The edge portions of the film support are customarily embossed by a knurling wheel to increase the effective thickness of the support. The increased thickness of the edges protects the sensitive photographic materials from higher localized winding pressure which occurs as a result of minute variations in support thickness. It is desirable to avoid applying any coating compositions to the knurled areas because inherent tackiness of photographic coatings at high humidity makes it difficult to unwind the support during finishing operations. One way of achieving this is to maintain a free falling curtain having a width less than the width of the support. Thus techniques for providing coating-free margins would be highly useful in connection with edge knurling of the support.

One prior art attempt to maintain the knurled edge portions coating-free has been to locate the edge guides in board of the edge of the support. However, this causes the coating to terminate along both edges of the support in a bead. Such edges must be cut off to provide a completely uniform coated support. Prior to a costly and wasteful trimming operation, however, such excessively thick beads of coating liquid can adversely affect drier efficiency and result in contamination of downstream transport rollers.

Other previous attempts to effect curtain coating within the knurled areas of the support (i.e., to provide coating-free margins) have not been completely successful. In U.S. Pat. No. 3,508,947, curtain edge guides are described which permit coating within the edges (FIGS. 7 and 8). The lower end of the edge guides is attached to a trailing brush or thin strip of flexible material which tends to spread out the excess coating liquid (edging band liquids and flushing liquids) at the edge of the coating. While partially successful, these edge guide attachments soon become covered with dirt, support slivers and dried coating solution and are soon rendered ineffective to produce uncoated areas within the knurled areas of the support material, especially when used for continuous coating operation required for photographic materials.

Thus, efficient use of the curtain coating method for manufacturing photographic materials has been adversely affected by the inability to develop effective coating within the edges of the support. Although various edge guide devices have been used to stabilize the falling curtain along its edges, the problem of providing reliable coating-free margins in a curtain coating method and apparatus still exists.

SUMMARY OF THE INVENTION

According to the present invention, there is provided a method of coating a support with at least one layer of a liquid coating composition, comprising moving the support along a path through a coating zone and forming at the coating zone a free falling curtain which extends transversely of the path and impinges on the moving support to deposit thereon a coating, the free falling curtain being in wetting contact with edge guides spaced apart by a distance to produce a coating less than the width of the support to be coated. The edge guides are connected to a suction device located near the point of impingement of the falling curtain, so that curtain fluids are extracted from the edges of the curtain before the curtain impinges on the support.

The present invention also includes within its scope apparatus for carrying out the method for coating a moving support, which is disclosed herein. In a preferred embodiment, such apparatus uses slotted tubes as edge guides. The flushing liquid is delivered to the slotted tube at the point at which the curtain starts its free fall, and the flushing liquid is partially or entirely extracted from the edges of the falling curtain at or near the point of impingement on the support by connecting the edge guide tube to a suction source.

The unexpected results achieved by my invention could not have been foreseen by the expert and constitute a significant technical advance in the art. The advantages of a method and apparatus of coating a support using a suction device located near the point of impingement of the falling curtain, so that a desired quantity of curtain fluids can be extracted from the edges of the falling curtain, are summarized as follows:

Excess curtain fluids can be extracted from the edges of the falling curtain to provide a uniform coating thickness of the layers of photographic compositions across the entire width of the coating, including the edges of the coating, thereby improving drier efficiency and reducing product waste.

Expensive delivery systems which supply edge band fluid onto the edges of a cascade hopper to establish edge portions of low viscosity fluids to the falling curtain can be eliminated.

The width of the coating within the edges of the support can be optimized according to the desired product requirement. An uncoated margin can be carried out with an effectiveness which results in significantly reducing the waste resulting from unusable support material.

Coating within the edges of the support provides a knurl edge area free from coating material. The ability to coat within the edges of the support also eliminates coating on the underside of the support, which occurs with a curtain coating technique wherein the falling curtain impinging on the support is wider than the support to be coated. Undried coating composition on the underside of the support will adversely affect downstream conveying equipment which transports the coated support through the drier.

When coating over the edges of the support, a coating roll of a width less than that of the support is required to avoid coating onto the supporting roller surface. Thus, frequent change to the coating rollers having different widths has been required to accommodate the particular width of the support coated. The method and apparatus of my invention allows for use of a universal width support roller because all coating is accomplished within the support edges.

Dirt and crusting faults attributed to the brush technique of the prior art are avoided by my invention.

The method and apparatus of my invention also result in elimination of collecting trays along each side of the coating zone area which previously have been necessary to remove excess curtain fluids in the area of the edge guides.

The advantages mentioned above result in an improved reliability of the curtain coating process, in better utilization of equipment, and in a significant elimination of excess machinery.

BRIEF DESCRIPTION OF THE DRAWINGS

The accompanying drawings will serve to illustrate the method and apparatus of the present invention.

DETAILED DESCRIPTION OF THE INVENTION

Figure 1:
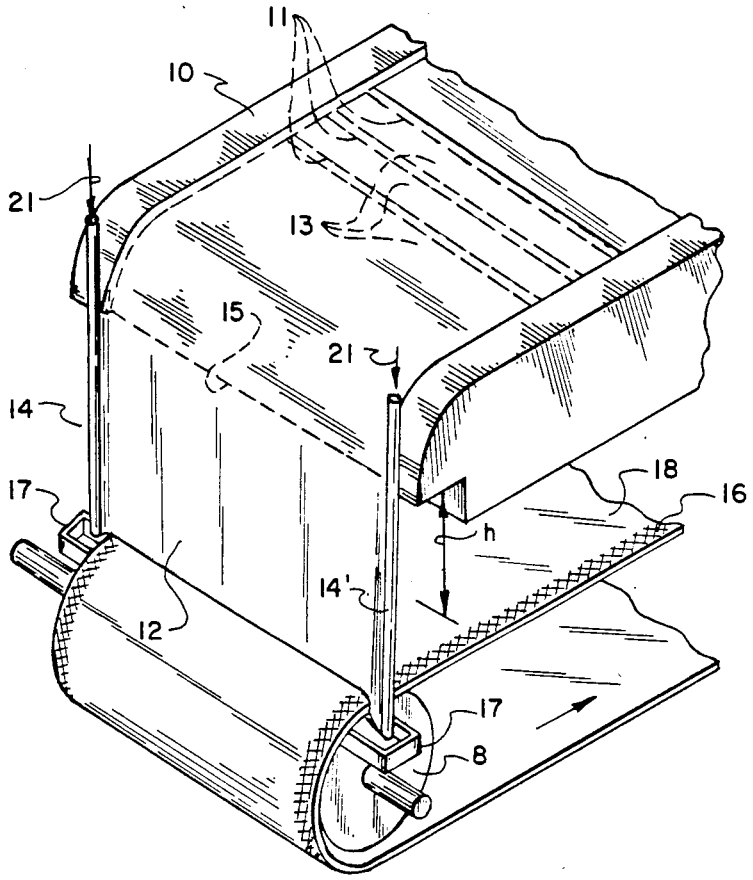
FIG. 1 (PRIOR ART)
FIG. 1 is a simplified perspective view of a curtain coating apparatus of the slide hopper type in accordance with the prior art.

The invention will now be described in more detail with reference to the known curtain coater of a slide hopper type as shown in FIG. 1. The coating liquids are delivered laterally to the slide hopper 10, ascend to exit slots 11, and are deposited in a form of a layer on the individual inclined surfaces 13. Under the effect of gravity, the individual layers flow down the surfaces 13, flow over one another, and flow to the coating edge 15 where a free falling composite curtain 12 is formed. The slide hopper can be any desired width, such as a width of from several inches to several feet. The free falling composite curtain 12, which extends transversely of the path of the moving support 18, drops over a height "h" and impinges onto the continuously advancing support 18 to form a composite of layers. At the point where the curtain 12 impinges the support, the support 18 is preferably guided onto and around a coating roller 8. The width of the coating roller can be narrower or wider than the width of the support 18 guided around it, depending on the edging technique. The coating roller 8 is mounted on and preferably driven by a motor which is not shown.

The layers of photographic coating composition can be coated on a variety of supports. Typically, photographic supports include polymeric film, wood fiber, e.g., paper, metallic sheet and foil, glass and ceramic supporting elements provided with one or more subbing layers to enhance the adhesive, antistatic, dimensional, abrasive, hardness, functional, antihalation and/or other properties of the support. It may be coated in the form of discrete sheets or, as is more usually the case, in the form of a continuous support.

The free falling liquid curtain 12 is laterally guided by two edge guides 14 and 14' which are vertically arranged and act to hold and stabilize the free falling curtain before it impinges on the support 18. The edge guides may be arranged in such a way that the moving support to be coated is coated less then the width of the support, or in such a way that the width of the coating liquid extends beyond the support on both sides. FIG. 1 illustrates one type of lateral curtain guiding system, wherein the edge guides 14 and 14' are arranged outside the edges of the moving support 18 to be coated so that the curtain 12 is wider than the support to be coated. In this case, the support is completely coated over its entire width over knurled edges 16, thereby any peripheral irregularities are situated in the area of the edge guides and therefore outside the useful width of the support. The coating fluids which drop past the edges of the support are collected in catch basins 17 for reuse, if practical.

Figure 2:
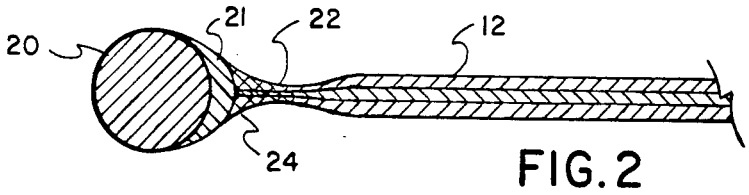
FIG. 2 is a cross-section view showing the surface of a solid edge guide flushed with flushing liquid.

In one of the ways to maintain the stability of the free falling curtain in the region of the edge guides, a low-viscosity liquid is delivered to the edge guides to have a "flushing" effect on the outer surface of a solid edge guide. FIG. 2 is a cross-section view of the free falling curtain 12, showing a solid edge guide 20 flushed with a flushing liquid 21 adjacent the edge guide and photographic fluid 12. Flushing the outer surface of the edge guides also acts to prevent contamination of the edge guides with dried coating composition. Because the curtain thickness 12 is on the order of 0.015–0.040 cm and the edge guide diameter is approximately 0.075–0.300 cm, the flushing liquid 21 will form a meniscus 24 about the edge guide due to surface forces. To form the meniscus 24, fluids are drawn from the falling curtain adjacent the edge guides, as indicated by the thinning region 22. The "flushing" effect on the outer surface of a solid edge guide has the disadvantage of causing instability of the falling curtain because of the thinning region 22.

Figure 3:
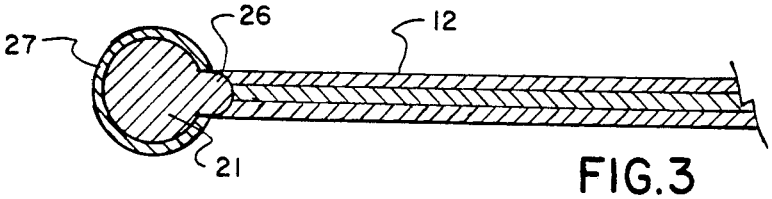
FIG. 3 is a cross-section showing a slotted edge guide using a flushing liquid.

Another way to maintain the stability of the free-falling curtain in the region of the edge guide is by delivering a low viscosity flushing liquid to a hollow, slotted edge guide in a manner disclosed in U.S. Pat. Nos. 3,632,374 and 4,479,987. FIG. 3 is a cross-sectional view of the free falling curtain showing a slotted edge guide 27 with the flushing liquid 21 introduced into the edge guide and disposed to feed laterally into the edge of the falling curtain through the slot 26. The flushing liquid 21 can be an inert, low viscosity liquid, for example, a clear gelatin solution or water. Because the slot is on the same order of magnitude as the curtain thickness (0.015–0.040 cm), an anchoring point for the curtain is provided by the sharp corners of the slot; therefore, the flushing liquid does not form a meniscus up to the edge guide as was the case when "flushing" the solid edge guide 20 described in FIG. 2. Therefore, with the slotted edge guide 27, the falling curtain 12 thickness remains constant throughout, providing improved curtain stability and uniform coverage.

Figure 4:
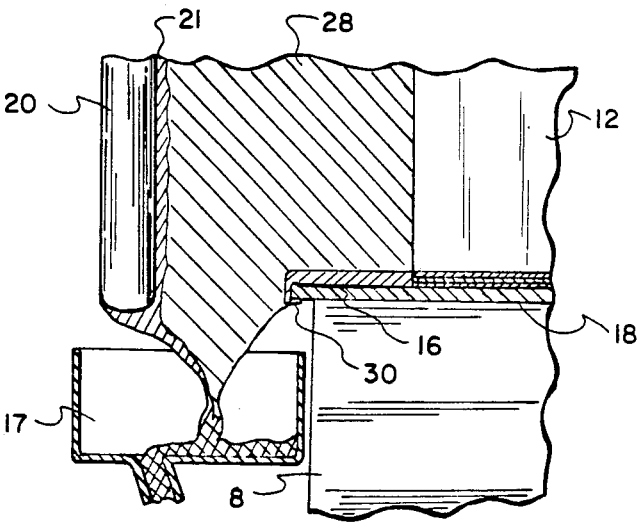
FIG. 4 (PRIOR ART)
FIG. 4 is a partial elevation view of a solid edge guide and a falling curtain extending beyond the edge of the moving support in accordance with the prior art.

FIG. 4 is a view of a solid edge guide 20 at the point where the free falling curtain impinges on the moving support. Flushing liquid 21 adjacent the edge guide and an edging band fluid 28 adjacent the flushing liquid 21 are shown being dispensed into catch pan 17 which leads to a drain (not shown). The liquid curtain can be seen to wet the backside of the support 18 at the edges of the support at 30 and also coat over knurled area 16. The liquids which coat the backside of the support will transfer to subsequent conveyance rollers and eventually require termination of the coating process in order to clean downstream conveyance rollers. The coating applied on the knurled area 16 results in problems in the finishing operation due to the tacky nature of the gelatin and the high winding pressures associated with the knurls.

Figure 5:
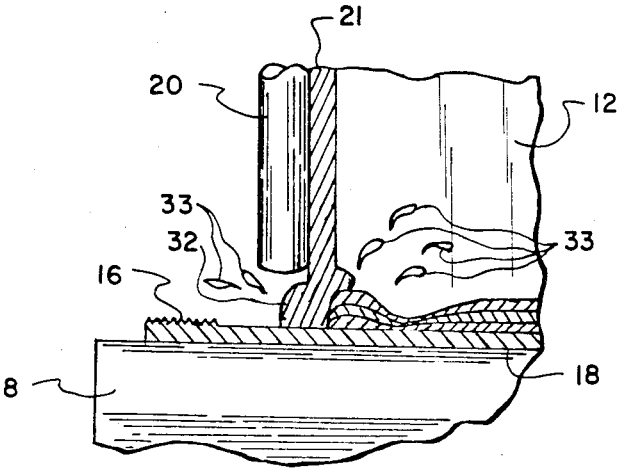
FIG. 5 (PRIOR ART)
FIG. 5 is a partial elevation view of a solid edge guide positioned within the edge of the moving support in accordance with the prior art.

FIG. 5 is a view of a solid edge guide 20 at the impingement point of the free falling curtain and the moving support 18 where the curtain width is less than the support width. Flushing liquid 21 located adjacent the edge guide and the photographic liquids of the falling curtain 12 located adjacent the flushing liquid are coated onto the moving support 18 inboard of the knurled area 16. Puddle 32 formed behind the curtain at the impingement point of the flushing liquid 21 and the moving support is caused by the poor coatability of the low viscosity and high flow rate of flushing liquid 21. Puddle 32 is the result of wetting failure and causes ejection of solution 33 from the puddle region to the adjacent area, resulting in an increase of product waste.

Figure 6:
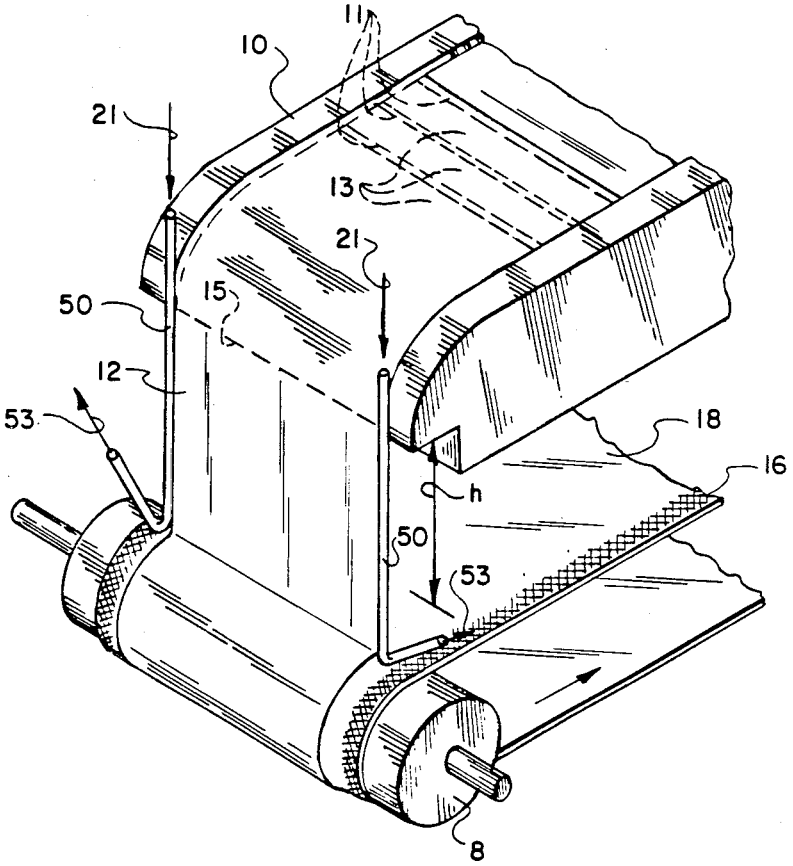
FIG. 6 is a simplified perspective view of curtain coating apparatus of the slide hopper type in accordance with one preferred embodiment of my invention.

In the embodiment of the present invention shown in FIG. 6, a slide coating hopper 10 has connected to it two bent, slotted edge guide tubes 50 arranged in such a way that the coating width is less than the width of the support 18. The free falling composite curtain 12 extends transversely of the path of the moving support 18, drops over a height "h", and impinges onto the continuously advancing support 18 to form a multilayer coating. Support 18 is preferably guided into and around a coating roller 8 at the point where curtain 12 impinges onto the support. A low-viscosity flushing liquid 21, preferably water, is delivered to the top of the slotted edge guide 50 and distributed over the entire height of the edge guide from the coating edge 15 to the point where the slotted edge guides bend upwardly, just above the point where the liquid curtain 12 impinges onto the support 18. Curtain liquids are extracted from the edge region of the falling curtain to substantially reduce the thickness at its edge region by connecting the end of the interior of guide edge 50 to a suction device 53, preferably near the point of impingement of the falling curtain. The extracted curtain liquids are removed to a containing device removed from the coating zone.

Figure 7A:
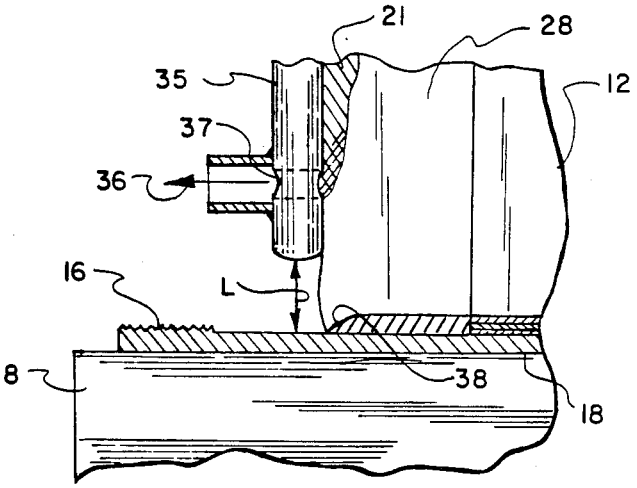
FIG. 7A is an elevation view, partially in cross-section, showing a fluid extraction point in accordance with an embodiment of the invention which uses a solid edge guide.

FIG. 7A is a partial elevation view illustrating the way in which a vacuum source 36 can be coupled to a solid edge guide 35 in accordance with another embodiment of the invention. The diameter of solid edge guide 35 can range from about 0.075 to 0.300 centimeter, and is flushed with a low-viscosity flushing liquid 21 and positioned to laterally guide free falling curtain 12. Solid edge guide 35 is spaced in close proximity to support 18 normally a distance "L" which can range from 0.002 to 1.0 cm.

A hole 37 extends through the lower extremity of the edge guide 35 close to the point of impingement of the falling curtain with the moving support. Preferably the diameter of evacuation hole 37 is 0.035 to 0.240 cm.

A vacuum source 36 of from about 125 cms of water to 1000 cms of water relative to atmospheric pressure is attached to hole 37 to extract curtain liquids from the edge region of the falling curtain. The location of hole 37 should insure the extraction of substantially all the flushing liquid 21 used to flush the edge guide. The diameter of the extraction hole 37 in the solid edge guide and the level of suction applied to extract liquids can be adjusted until the quantities of flushing liquid extracted from the edge region of the falling curtain results in providing a distinct layered profile to the edge region of the coating as noted in area 38 without the undesirable puddle formation described in FIG. 5.

The quantity of flushing liquid extracted from the edge region of the falling curtain will obviously depend on the flow rate of the flushing liquid, which can range from 5 to 50 cubic centimeters per minute. Extraction of the flushing liquid from the edge region of the free falling curtain was found to be independent of the flow rate of the falling curtain and the coating speed, which can range from 100 to 700 centimeters per second.

The location of hole 37 in solid edge guide 35 is not critical, but to be effective it is preferably 0.2 to 1.2 centimeter from the point of impingement of the curtain 12 on support 18. Location of hole 37 above the preferred range will make the edge guide less effective at stabilizing the curtain and avoiding contaminants as discussed above. Instead of a round hole, any cross-sectional area can be used, such as an elongated slot or several smaller holes having together the cross-sectional area required to extract the flushing liquid. When my inventive device as described in FIG. 7A is operated in the preferred range discussed above, there is no loss in the stability of the falling curtain along the entire length of the edge guide. By adjusting the suction level and the cross-sectional area of hole 37 in the flushed solid edge guide, together with the flow rate of the flushing liquid, a distinct layered edge region of the composite coating 38 can be obtained. This edge region can be efficiently dried, together with the photographic coating.

FIG. 7A also illustrates another embodiment of my invention combining the function of a flushing liquid 21 and the edging band liquid 28 supplied to the edge regions of the curtain to increase the stability of the curtain. Generally, when using an edging band liquid, it is advantageous to supply a sufficient quantity of edging band liquid to the edges of the slide hopper so that the thickness of the curtain and thus the flow rate of edging band liquid is somewhat greater than the thickness and flow rate of the center curtain, thereby greatly increasing the stability of the curtain at the edge guides and thus avoiding curtain breaks. It can be appreciated that the width and thickness of the curtain edge band liquid are such that a relatively large quantity of flushing liquid may be required, typically 2 liters per minute or more. The process provides good results when the edging band liquid viscosity approximates the viscosity of central curtain coating liquids. Gelatin solutions of appropriate concentration with added wetting agents are suitable.

When an edging band liquid is coated, the coating thickness of the edging band liquid should not be significantly greater than the remainder of the coating in order to assure that the entire coating will be effectively dried. Substantially all of the flushing liquid 21 is extracted from the edge portion of the curtain.

Figure 7B:
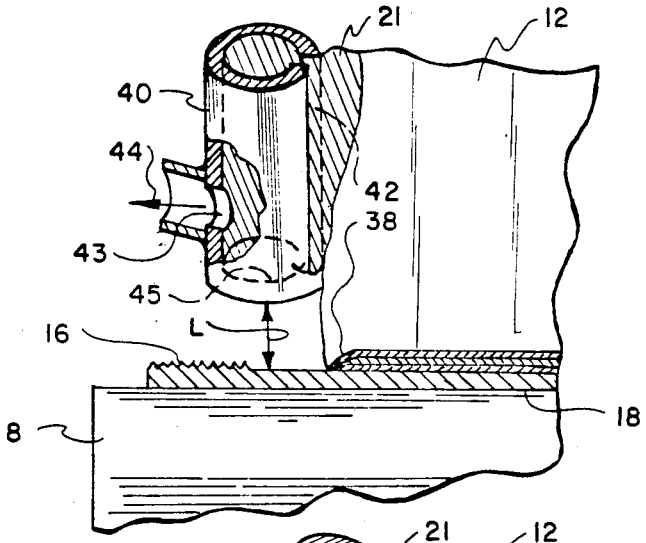
FIG. 7B is a partial three-dimensional view, partially in cross-section, showing the fluid extraction point in another preferred embodiment of the invention.

In a preferred embodiment of my invention, slotted tubes are used as edge guides and arranged in such a way that the coating is less than the width of support 18. FIG. 7B is a partial detailed elevation view illustrating the vacuum source relating to a slotted edge guide 40. Slot 42 is disposed to feed flushing liquid 21 laterally into the edge of the falling curtain 12.

Slot 42 extends the entire length of edge guide 40 from a point near lip 15 of the slide hopper where curtain 12 starts its free fall to a point proximate the line of impingement of the curtain. Slotted edge guide 42 is spaced a distance "L" from the.support, which distance can range from about 0.002 to 1.0 cm from the support. Slotted edge guide 40 is closed at the bottom and has an outside diameter of about 0.075–0.300 cm and an inside diameter of about 0.035–0.240 cm. The width of slot 42 in the edge guide tube is approximately matched to the thickness of the falling curtain, recognizing that the curtain is continuously being thinned in free fall. A slot of from about 0.007–0.040 cm has been found satisfactory for most curtain flow rates. It is understood that the curtain flow rate can vary over a wide range depending on the coating speed and the thickness of the coating, and consequently it may be necessary to adjust the width of the slot for different coating conditions.

Observation of slotted edge guide 40 after the curtain has been established showed that the flushing liquid 21 did not wet the exterior surface of the edge guide tube. The outside surfaces of the falling curtain were anchored at the corners formed by the slot with the outside surface of the tube (see FIG. 3) whereas, with flushing the exterior surface with flushing liquid of a solid edge guide, a large portion of the exterior surface is wet by the flushing liquid (see FIG. 2). Use of slotted edge guides which anchor the curtain to the corners of the slot increase the stability of the curtain.

It was found that, when a suction source 44 is connected to evacuation hole 43 near the end of the slotted edge guide, a substantial portion of the flushing liquid 21 supplied to the curtain at the top of the tube is removed. Preferably, evacuation hole 43 has a diameter of from about 0.035 to 0.240 cm and is located opposite the lower extremity of slot 42 with the tube closed at tube end 45. Fluid flow calculation indicated that most of the flushing liquid 21 is removed in the last centimeter of the slot at the end of the curtain free fall. With a sufficient vacuum on the suction source, e.g., from 125–1000 centimeters of water relative to atmospheric pressure, essentially all the flushing liquid 21 and even a small quantity of curtain fluids can be extracted. By controlling the vacuum level of the suction source and the flushing liquid flow rate which can range from about 10 to 200 cubic centimeters per minute, varying fractions of the flushing liquid can be extracted.

It was found that, when the flushing liquid is adequately extracted, the edge region of the coating was free from a thickened edge, resulting in a distinct layered profile of coating compositions as illustrated by 38. By the method of this invention and particularly when slotted edge guides are used with a suction source of extraction at a point close to the line of impingement of the curtain, a highly stable curtain is possible which can be coated within the edges of the support, resulting in an edge region having a distinct, layered coating profile. To maintain stability of the curtain, it may be desirable to coat a small fraction of flushing liquid. The quantity of the flushing liquid coated on the support should be kept to a minimum to avoid the wetting failure resulting from "puddling" discussed above.

Figure 7C:
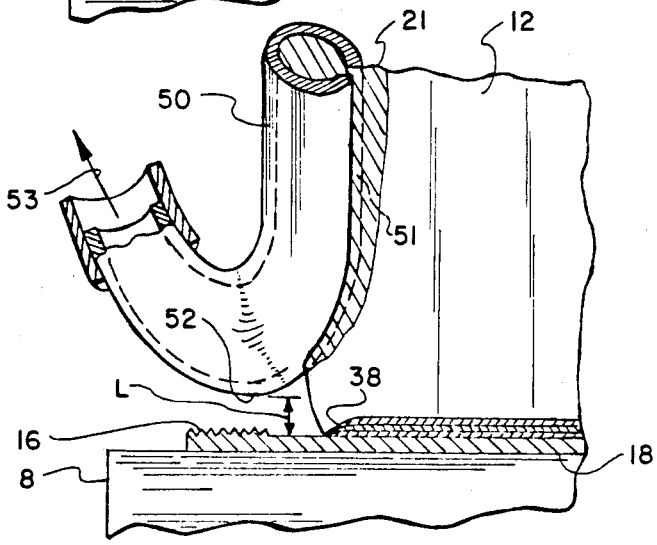
FIG. 7C is a partial three-dimensional view, partially in cross-section, showing the fluid extraction point in another embodiment of the invention.

FIG. 7C is a partial detailed elevation of another embodiment of a slotted edge guide tube which can be used with my invention. Slotted tube 50 is shown having a slot 51 with a bent configuration 52 and a vacuum source evacuation outlet 53. Preferably the bent-up slotted tube has an inside radius of about 0.300–1.20 centimeters. Slot 51 extends the entire length of edge guide 50 from a point near the lip of the slide hopper where curtain 12 starts its free fall to a point near the line of impingement of the curtain. Slotted tube 50 is spaced so that the lowest part of the tube is a distance "L" from the support, which distance can range from about 0.002 to 1.0 centimeter. Slotted tube 50 has an outside diameter of about 0.075 to 0.300 centimeter and an inside diameter of about 0.035 to 0.240 centimeters. The width of slot 51 is approximately matched to the thickness of the falling curtain, recognizing that the curtain is continuously thinned in free fall. A slot of from about 0.007–0.040 cm has been found satisfactory for most curtain flow rates. Use of slotted edge tubes which anchor the curtain to the corners of the slot also appears to increase the stability of the curtain. The lower extremity of slot 51 should be spaced at least within 0.450 cm of the lowermost portion of slotted tube 50.

It was found that, when a suction source 53 of from about 125 to 1000 centimeters of water relative to atmospheric pressure is connected to the end of the bent slotted tube 50, a substantial portion of the flushing liquid 21 supplied to the curtain laterally thru slot 51 could be removed. Most of the flushing liquid 21 is removed in the last centimeter of the slot just at the end of the curtain free fall. By controlling the vacuum level of the suction source and the flushing liquid flow rate, varying amounts of the flushing liquid 21 can be extracted, as well as small portions of the edge region of falling curtain 12. This embodiment therefore provides a highly stable curtain which can be coated within the edges of the support, resulting in a coating of a distinctly layered profile shown in area 38.

Figure 8A:
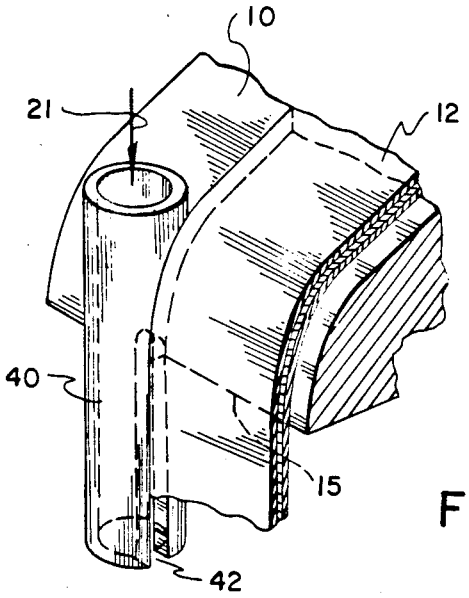
FIG. 8A is a partial three-dimensional view of the flushing liquid supplied to the top of a slotted edge guide.

In FIG. 8A, a low-viscosity flushing liquid 21 is delivered to the top of a slotted edge guide 40 and distributed over the entire height of the edge guide from the coating edge 15 to the point where slot 42 ends just above the point where the liquid curtain impinges on the support. Flushing liquid 21 issues through slot 42 in the plane of and laterally toward the curtain, and contiguous with the coating liquids of the curtain 12 as the curtain begins its free fall at coating edge 15.

The width of the slot greatly affects the flow rate and velocity of flushing liquid from the slot. When one considers the cross-sectional area of the edge guide tube to the area of the slot (length times width), in the embodiments described in FIGS. 7B and 7C, it is apparent that the first centimeter of the slot has more than the cross-sectional area of the tube feeding the flushing liquid. It was found that a tube with an outside diameter of 0.20 centimeter and an inside diameter of 0.10 centimeter with a 0.02 centimeter slot width gave satisfactory results. The first centimeter of slot length has an area of 0.02 square centimeter, while the cross-section area of the tube is 0.008 square centimeter. Fluid flow calculations show that most of the flow of flushing liquid occurs in the first centimeter of slot length. Therefore, essentially all of the flushing liquid is introduced to the curtain at or near the lip of the hopper where the curtain starts its free fall. Only a small quantity of flushing liquid is required, for example, a flow rate of from 10 to 200 cc/min., so that the width of the flushing liquid issuing from the slot adjacent to the curtain is only a few millimeters. Because most of the flushing liquid is introduced in the first centimeter of the edge guide where the curtain first starts to accelerate, almost all of the flushing liquid supplied is available throughout the entire length of the curtain free fall. This maximizes the effectiveness of the low-viscosity flushing liquid for reducing the velocity gradient in the curtain adjacent the slotted edge guides, resulting in greater stability of the curtain at its edges. Therefore the flushing liquid 21 is positively delivered to the curtain at its edges in a quantity depending upon flushing liquid viscosity, flow rate and the slot width until it reaches the evacuation point where it is removed near the impingement of the falling curtain with the support as discussed above.

Figure 8B:
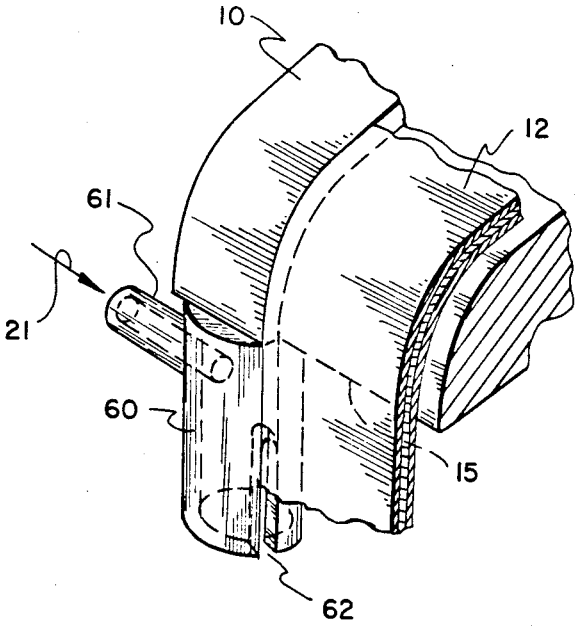
FIG. 8B is a partial three-dimensional view of the flushing liquid supplied to the side of the slotted edge guide.

FIG. 8B is still another embodiment of a slotted edge guide tube 60 positioned to guide laterally the free falling curtain 12 in a manner similar to the slotted edge guides 40 described in FIG. 8A. Edge guide 60 is positioned below coating edge 15 where the curtain contacts flushing liquid 21 issuing from slot 62. Flushing liquid 21 is delivered to edge guide 60 through a supply pipe 61 located at the upper end of the edge guide opposite slot 62. To prevent undesirable disturbance to the edge of the falling curtain and assure uniform distribution of the flushing liquid over the entire height of the slotted edge, supply pipe 61 is preferably located above the starting point of slot 62.

The following example illustrates the advantages of the method according to the invention using the edge guide embodiments shown in FIGS. 7A, 7B or 7C for the production of photographic material. A slide coater of the type illustrated in FIG. 6 is provided with edge guides of the type shown in FIGS. 7A, 7B or 7C for a three-layer coating.

The free falling curtain height "h" was 25 cm, and the point of impingement of the curtain on the support usually defined as the application point was the midpoint of the coating roll. In referring herein to the application point, reference is made to the angle, either positive or negative, by which the plane defined by the free falling curtain deviates from the midpoint of the coating roll which transports the support.

A three-layer photographic coating composition was used consisting of an aqueous gelatin having a 30 centipoise viscosity for the bottom layer, a 50 centipoise viscosity for the middle layer and a 70 centipoise viscosity for the top layer. The flow rate for the three-year composite coating was 4 cubic centimeters/second-/centimeter.

EXAMPLE 1

A solid rod edge guide illustrated in FIG. 7A was vertically arranged in such a way that the coating is less than the width of the support. A polyethylene-coated, 0.023-cm-thick paper support was used as the support. A water solution was provided to flush the outside surface of the solid rod edge guide in a known manner. An edging band liquid was supplied to the edge region of the curtain. A vacuum was applied to the extraction hole.

| | |
|---|---|
| Solid rod edge guide OD | 0.150 cm |
| Flushing liquid viscosity | 1.0 centipoise |
| Flushing liquid flow rate | 12 cc/min |
| Evacuation hole diameter | 0.075 cm |
| Evacuation hole distance from the support | 0.450 cm |
| Vacuum applied to evacuation hole | 650 cm of $H_2O$ relative to atmospheric pressure |
| Solid rod edge guide to support spacing | 0.300 cm |
| Coating speed | 400 cm/sec |

The end of the solid edge guide located 0.300 cm above the support results in a slight necking of the curtain as it free falls to the moving support. When the flushing liquid was extracted at the lower extremity of the edge guide in the area of the edge region of the falling curtain, the distinct layered profile of the edge of the coating was uniform and satisfactory. This allowed for the edge region of the coating to be dried at approximately the same point in the coating machine as the rest of the coating. Furthermore, the uncoated margin of the support resulted in complete elimination or a substantially reduced coating over the knurled area. Extraction of the flushing liquid was found to have no effect on the stability of the falling curtain.

EXAMPLE 2

A slotted edge guide illustrated in FIG. 7B was vertically arranged so that the coating is less than the width of the support being coated. A cellulose triacetate film 0.013 cm thick was used as the support. A water solution was provided to the top of the slotted edge guide as illustrated in FIG. 8A. Vacuum was applied to the evacuation hole located at the end of the edge guide positioned opposite the lower extremity of the slot.

| | |
|---|---|
| Slotted edge guide OD | 0.150 cm |
| Slotted edge guide ID | 0.075 cm |
| Slot width | 0.015 cm |
| Evacuation hole diameter | 0.075 cm |
| Flushing liquid viscosity | 1.0 centipoise |
| Flushing liquid flow rate | 35 cc/min |
| Coating speed | 400 cm/sec |
| Vacuum applied to evacuation hole | 650 cm of $H_2O$ relative to atmospheric pressure |
| Distance of evacuation hole from the support | 0.450 cm |
| Slotted edge guide to support spacing | 0.300 cm |

When the flushing liquid was extracted at the lower end of the slotted edge guide using a vacuum source of 650 cm of $H_2O$ relative to atmospheric pressure, it was found that about 40 cubic centimeters per minute of liquid were being extracted from the end region of the falling curtain without affecting the curtain stability. It was also found that the edge region of the coating formed a distinct layered profile of each coated layer with no unsatisfactory beading or thickening of the coated edge. This allowed for a uniform coated edge region which could be dried at the same conditions required for the rest of the coating.

EXAMPLE 3

A slotted bent edge guide illustrated in FIG. 7C was vertically arranged to produce a coating less than the width of the support being coated as further shown in FIG. 6. A polyethylene terephthalate film, 0.018 cm thick, was used as a support. A water solution was provided to the top of the slotted edge guide as illustrated in FIG. 8A. Vacuum was applied at the end of the edge guide as shown in FIG. 7C.

| | |
|---|---|
| Slotted edge guide OD | 0.150 cm |
| Slotted edge guide ID | 0.075 cm |
| Slot width | 0.015 cm |
| Bend-up inside radius of slotted edge guide | 0.600 cm |
| Slotted edge guide to support spacing | 0.300 cm |
| Vacuum applied to the end of bend-up slotted edge guide | 650 cm of $H_2O$ relative to atmospheric pressure |
| Flushing liquid viscosity | 1.0 centipoise |
| Flushing liquid flow rate | 35 cc/min |
| Coating speed | 400 cm/sec |

Similar necking of the curtain as it free falls to the moving support was observed as discussed in Example 1. Extraction of the flushing liquid from the edge region of the falling curtain was found to be about 40 cubic centimeters per minute with no adverse effects on the stability of the curtain. A distinct, layered coating edge was observed with no beading or thickening of the coated edge as shown in FIG. 7C.

My invention provides for the selection of a wide range of slot width, lengths and interior diameter of the edge guide for delivering the desired quantity of flushing liquid to the edges of the curtain during its free fall. By metering the flushing liquid delivery line and controlling the vacuum source applied to the evacuation point of 125–1000 cm of water relative to atmospheric pressure, the quantity of flushing liquid extracted at the lower portion of the edge guide can be adjusted to maintain a stable curtain which is independent of curtain flow rates, as well as coating speed.

The invention has been described in detail with particular reference to preferred embodiments thereof, but it will be understood that variations and mode functions can be effected within the spirit and scope of the invention as described hereinabove and as defined in the appended claims.

I claim:

1. A method of curtain coating a support, with at least one layer of a liquid coating composition, comprising the steps of:

(a) moving the support along a path through a coating zone;

(b) forming a plurality of flowing layers of coating liquids to form a composite layer;

(c) forming a free falling vertical curtain from said composite layer within said coating zone which extends transversely of said path and impinges on said moving support;

(d) laterally guiding said falling curtain by edge guides arranged to coat less than the width of said support;

(e) maintaining said falling curtain in wetting contact with said edge guides by distributing flushing liquid from said edge guides contiguous with said falling curtain; and (f) extracting liquids from the edge of said falling curtain by a vacuum source connected to said edge guide near the point of impingement of said falling curtain.

2. A method according to claim 2 wherein the edge region of the coating forms a distinct layered profile of each coated layer which can be dried at the same point in the drier as the coating.

3. A method according to claim 1 wherein the quantity of flushing liquid introduced into the edge guides ranges from 5 to 200 centimeters per minute.

4. A method according to claim 3 wherein the step of extracting curtain liquids from the edge of the falling curtain is by applying a vacuum of from 125 to 1000 centimeters of water relative to atmospheric pressure.

5. A method according to claim 4 wherein the quantity of curtain liquids extracted from the edge of the falling curtain is controlled by the vacuum and flow rate of the flushing liquid.

6. A method according to claim 4 wherein said flushing liquid is a low-viscosity liquid having viscosities of 1 to 10 centipoise.

7. A method according to claim 1 wherein said edge guides are solid rods spaced about 0.002 to 1.0 cm from said support.

8. A method according to claim 1 wherein said edge guides are slotted tubes disposed to feed flushing liquid laterally into the edge of the falling curtain and spaced about 0.002 to 1.0 centimeter from said support.

9. A method according to claim 1 wherein said edge guides are bent-up slotted tubes having an inside radius of about 0.300 to 1.20 centimeter further comprising a vacuum source connected to the end of the bent-up slotted tube.

10. A method according to claim 8 wherein the flushing liquid is introduced into the upper end of the slotted edge guide above the starting point of the slot.

11. A method according to claim 10 wherein a slotted edge guide comes into wetting contact with the falling curtain at the point said curtain starts free fall.

12. Method according to claim 8 wherein the width of the slot ranges from about 0.007 to 0.040 centimeter.

13. Method according to claim 12 wherein the quantity of curtain liquids extracted from the edge of the falling curtain is controlled by the vacuum and the flow rate of the flushing liquid.

14. Method according to claim 2 wherein the speed of moving the support through the coating zone ranges from 100 to 700 centimeters per second.

15. Apparatus for curtain coating a support by depositing a plurality of coating liquids onto a moving support, comprising:

(a) conveying means including a coating roll for moving said support along a path through a coating zone;

(b) hopper means for forming a plurality of flowing layers of coating liquids to form a composite free falling curtain which extends transversely of said path and impinges on said moving support;

(c) edge guide means, spaced apart a distance to produce a coating less than the width of said support, for laterally guiding said falling curtain;

(d) flushing means for issuing liquid from said edge guide to maintain wetting contact with said falling curtain; and (e) suction means for extracting liquid from the edge region of said falling curtain by a suction device connected to said edge guide near the point of impingement of said falling curtain.

16. Apparatus according to claim 15 wherein said edge guide means are solid rods spaced about 0.002 to 1.0 centimeter from said support.

17. Apparatus according to claim 15 wherein said edge guide means are slotted tubes disposed to introduce flushing liquid laterally into the edge of the falling curtain and spaced about 0.002 to 1.0 centimeter from said support.

18. Apparatus according to claim 17 wherein said edge guide means have a slot width of about 0.007 to 0.040 centimeter.

19. Apparatus according to claim 15 wherein said edge guide means are bent-up slotted tubes having an inside radius of about 0.300 to 1.20 centimeters and wherein said suction means is connected to the end of the bent-up slotted tube.

20. Apparatus according to claim 19 wherein said bent-up guide means have a slot width of about 0.007 to 0.040 centimeter and spaced 0.002 to 1.0 centimeter from said support.

21. Apparatus according to claim 15 wherein said flushing means includes a device to introduce flushing liquid to said edge guide means of from 5 to 200 centimeters per minute.

22. Apparatus according to claim 17 wherein flushing liquid is introduced to the upper end of said slotted edge guide above the starting point of the slot.

23. Apparatus according to claim 15 wherein said suction means comprises a vacuum source of from 125 to 1000 centimeters of water relative to atmospheric pressure.

24. Apparatus according to claim 15 wherein said flushing means and suction means further comprise controlling means to extract the quantity of curtain liquids from the edge of the falling curtain.

25. Apparatus according to claim 15 wherein said conveying means for moving said support along a path through the coating zone ranges from 100 to 700 centimeters per second.

* * * * *